United States Patent [19]

Luderer et al.

[11] 3,937,401

[45] Feb. 10, 1976

[54] ELECTROSTATIC COATING

[75] Inventors: Manfred Luderer, Weiler zum Stein; Roland Wiedmann; Karl Rapp, both of Winnenden, all of Germany

[73] Assignee: Firma Ernst Mueller K. G., Winnenden, Germany

[22] Filed: Apr. 1, 1974

[21] Appl. No.: 456,827

[30] Foreign Application Priority Data

Apr. 6, 1973 Germany ..... 2317448
Jan. 17, 1974 Germany ..... 2402209

[52] U.S. Cl. ..... 239/15
[51] Int. Cl.[2] ..... B05B 5/00
[58] Field of Search ..... 239/15, 3

[56] References Cited

UNITED STATES PATENTS

| | | | |
|---|---|---|---|
| 2,890,388 | 6/1959 | Croskey et al. | 239/15 UX |
| 2,959,353 | 11/1960 | Croskey et al. | 239/15 |
| 3,613,993 | 10/1971 | Collier et al. | 239/15 |
| 3,677,470 | 7/1972 | Probst et al. | 239/15 |
| 3,767,115 | 10/1973 | Kozinski et al. | 239/15 |
| 3,837,573 | 9/1974 | Wagner | 239/15 |

*Primary Examiner*—John J. Love
*Attorney, Agent, or Firm*—Burns, Doane, Swecker & Mathis

[57] ABSTRACT

An electrostatic spray gun includes a housing, a nozzle with a coating material discharge opening, and means for connection to an electric resistor and high voltage cable. An electrode is carried by an electrode extension body so as to be disposed forwardly of the nozzle discharge opening at a distance sufficient to effectively charge spray particles of a coating material having high conductivity. The extension body can be adjustable in position to accommodate an adjustable nozzle, while still making effective electrical contact with the resistor.

11 Claims, 6 Drawing Figures

ELECTROSTATIC COATING

BACKGROUND AND OBJECTS OF THE INVENTION

The invention relates to a sprayer arrangement for the electrostatic coating of objects with liquid or powdery material. The sprayer is of the type which includes a pistol barrel, an atomizer nozzle located at the outlet of the barrel and fed with coating material via a feed line running in the pistol barrel. An electrode for charging the atomized material is connected to a high voltage generator by way of a high-impedance, current-limiting resistor in the gun and a high voltage cable running in or on the pistol barrel.

Such spraying arrangements particularly for spraying dyes or lacquers have been on the market in large numbers, whereby the high voltage electrode, perhaps in the form of a metal needle, is disposed in the atomizer nozzle or immediately adjacent thereto. The creation of an electric return line from the electrode via the dye or lacquer feed, the consequence of which being a considerable decrease of the charge voltage available at the electrode, is not to be feared in this case generally. This is so because the lacquers, or else the powders, have such a high electric resistance value that they can be designated almost as insulators. This is true even for known metal lacquers because in their case the individual metal particles are encased in the insulating lacquer.

Recently however, so-called water paints have come on the market, for example plastic paints, which are dilutable with water. These paints have such a high electric conductivity in the water-diluted state that they can no longer be sprayed electrostatically with the abovementioned known devices. This is because the electric current flow through the spray particles is so large that the voltage available is too low to create an adequate supply of electrostatically charged particles to provide the benefits of electrostatic spray coating. Expressed in other words, during spraying of such water paints, the necessary electrostatic high voltage field between the electrode and the object to be sprayed, and/or a ground, collapses. Moreover there is a danger of electric shuntings in the case of fouling of the spraying arrangement by the water paint occurring perforce during operation, a factor which not only decreases the operating efficiency of the device, but beyond that even endangers the operator.

One object of the invention is to minimize or obviate problems of the above-discussed type.

Another object of the invention is to improve the spraying arrangements of the initially mentioned type in such a way that it will be possible with them also to spray materials of considerable conductivity, especially also water paints, without trouble and danger electrostatically.

BRIEF DESCRIPTION OF THE PREFERRED EMBODIMENTS OF THE INVENTION

According to the invention, these objects essentially are solved by a spraying assembly including an elongated body of insulating material running essentially parallel to the longitudinal axis of a pistol barrel is attached to the pistol barrel at the free end thereof. Located at a distance in front of the termination of the pistol barrel is an electrode, preferably a metal needle. Thus, the elongated body constitutes an electrode extension body. An electric conductor is embedded into the body of insulating material, which conductor connects the electrode with an electric contact which is located on the pistol barrel, and which is covered up by the body of insulating material. The contact, on its part, is connected with the high voltage cable. The distance between the atomizer nozzle and the extended electrode is selected so that even in the case of feeding-in of coating material of considerable conductivity to the atomizer nozzle, the voltage drop at the current limiting resistor, due to the active current from the atomizer nozzle via the atomized particles of the material to the electrode, remains at a low value. This guarantees an intensive electrostatic charging of the coating material. In this manner, a simple and safe insulation of the high voltage line up to the electrode will be assured. Moreover, because of the considerable distance between the electrode and the paint-discharging atomizer nozzle, the flowing of a considerable active current across the paint is prevented.

Particular difficulties concerning the electric insulation will result whenever the paint is sprayed in the form of a flat jet and wherein the plane of the flat jet is twistable around the longitudinal axis of the pistol barrel, which generally is desirable. In such instances it would be desirable that the extended electrode be disposed outside of the flat jet spray. In order to assure in this case that the electrode will always remain outside of the plane of the flat jet, the present invention provides that the body of insulating material carrying the electrode will likewise be arranged rotatably. In this fashion, the electrode can always be brought into a plane that lies perpendicularly to the middle axis of the flat jet. According to the invention, one can proceed in this case in such a way, that the body of insulating material has an annular foot which is twistable on the pistol barrel. Special measures have been taken in order to screen off perfectly the connection between the locally fixed contact point on the pistol barrel and of the twistable contact point of the insulating body.

Another solution to the adjustable flat jet spraying problem according to the invention consists in the fact that the pistol barrel has a flange of insulating material projecting from the jacket of the pipe in the shape of a ring or a partial ring. The flange is provided with several receiving bores extending essentially parallel in relation to the longitudinal axis of the pistol barrel. An electrode extension body may be selectively plugged into the bores.

THE DRAWINGS

In the drawings, embodiments of the invention are shown by way of example:

FIG. 1 shows a side view partially in longitudinal section, of the front area of a manual spray gun in accordance with a first embodiment of the invention, FIG. 2 is a view like FIG. 1 of a second embodiment of the invention, FIG. 3 is a front view of the mouth of the spray gun of FIG. 2, FIG. 4 is a view similar to that of FIG. 2 showing a modified form of the second embodiment, FIG. 5 is a view like FIG. 2 of another modified form of the second embodiment, FIG. 6 is a view like FIG. 2 of still another modified form of the second embodiment.

DETAILED DESCRIPTION OF THE PREFERRED EMBODIMENTS

Figure 1:
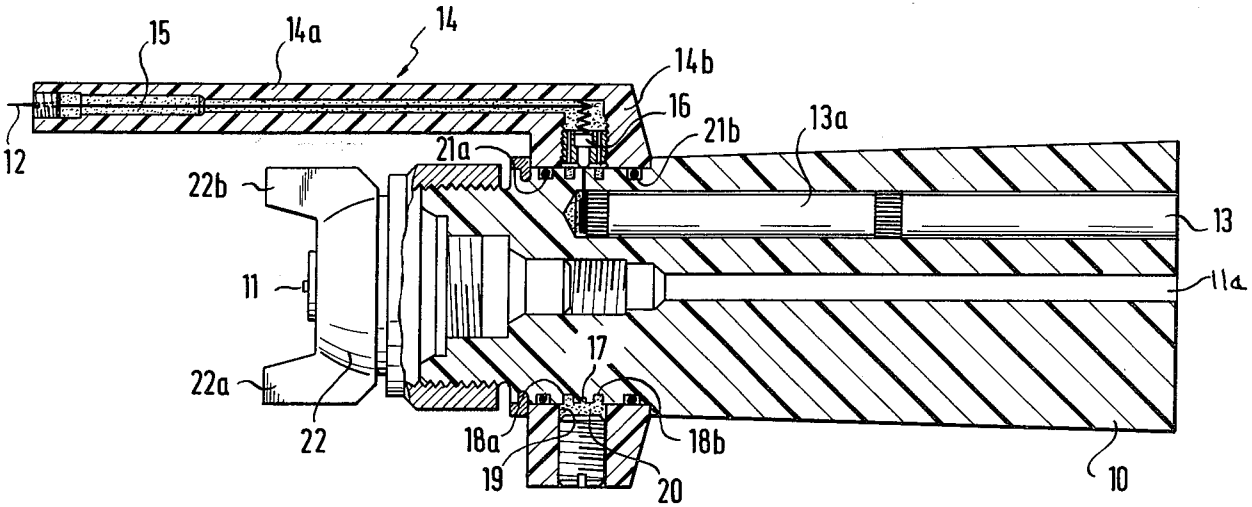

In the case of the preferred spraying device according to FIG. 1, we are dealing with a device wherein atomization is accomplished by compressed air and wherein a flat jet is formed through a nozzle of the known air horn-type. Naturally however, the invention can also be used for other spraying arrangements, for example, where atomization is accomplished by means of hydrostatic pressure and the atomizer nozzle is an air jet.

The spray gun housing is shaped as a pistol barrel, of insulating material, and is designated by the numeral 10. At the mouth of the pistol barrel there is a nozzle 11 having discharge opening means from which the paint is ejected during operation. Coating material is fed to the nozzle through a coating material feed line 11*a*, the nozzle being located at a discharge end of said feed line 11*a*. The high voltage electrode is designated by numeral 12 and the high voltage feed-in by numeral 13. The feed-in 13 has a high-impedance, current-limiting resistor 13*a* running in the pistol barrel 10, as is desirable.

A body 14 of conventional plastically moldable insulating material consists of an elongated, perhaps cylindrical part 14*a* and a foot 14*b* in the form of a ring being in one piece with the cylindrical part. The body 14 of insulating material is rotatably attached onto the barrel 10 and can be swivelled around the longitudinal axis of the barrel. A conductor 15, connected with the electrode 12, runs in the body 14. This conductor 15 is connected in the annular foot 14*b* with a spring-loaded contact pin 16. The contact pin 16 contacts a slip ring 17 by means of spring pressure, the slip ring being set into the jacket of the pistol barrel 10. The ring 17, on its part, is connected with the high voltage feed 13. On both sides of the slip ring 17, annular grooves 18*a* and 18*b* are molded into the jacket of the pistol barrel, which grooves together with an annular recess 19 in the foot 14*b* constitute an annular chamber 20. The annular chamber 20 is filled with saponified transformer oil. For the purpose of sealing the chamber 20, additionally two annular grooves 21*a* and 21*b* are provided in the jacket of the pistol barrel into which gaskets are inserted.

The body 14 comprises an electrode extension body arranged to locate the electrode 12 forwardly of the nozzle discharge opening means by a distance which is selected in accordance with the conductivity of the coating material. The selected difference is chosen so that an intensive charging of the coating material may be effected while maintaining the voltage drop at the electrical resistor means below a predetermined minimal value. That is, despite the high conductivity of the coating material, the current flow through the coating material itself is minimized by the extension of the electrode from the nozzle discharge opening means.

As mentioned in the case of the device shown, we are preferably dealing with a gun which uses compressed air for the atomization of the varnish. The nozzle head 22 surrounding the nozzle 11 serves for the achievement of a flat jet. In this connection, the two tips of head 22*a* and 22*b* compress flatly the emerging jet of varnish. In the position according to the drawing, the flat jet then lies in a plane perpendicular to the plane of the paper. In that case, the electrode 12, as is desired, is outside of the flat jet plane. Expressed more precisely, the electrode 12 lies in a plane passing through the jet 11 perpendicular thereto. If now, however, the head 22 is twisted in relation to the pistol barrel 10, for example by 90°, then the electrode 12 would be within the plane of the flat jet. This would be followed not only by a considerable fouling of the electrode and the body 14*a*, but also would increase the danger of a considerable flow of current through the coating material to the electrode, whenever the enamel or varnish coating material is highly conductive. According to the invention however, the body of insulating material 14 and thus the electrode 12 can likewise be twisted into such a position that the electrode 12 will again lie outside of the plane of the flat jet. Therefore, if the head 22 for example is twisted clockwise by 90°, as mentioned, then the body of insulating material 14 is likewise twisted by 90°. It will be at the option of the operator as to whether the twisting of the body of insulating material takes place likewise in a clockwise direction or in a counterclockwise direction. The electric connection of the electrode by way of the conductor 15, pin 16 and the slip ring 17 to the high voltage cable 13 remains intact during this twisting, because the contact pin 16 slides on the ring 17. Despite this possibility of twisting between the pistol barrel 10 and the body of insulating material 14, an excellent insulation is still assured, because the annular chamber 20, filled with saponified transformer oil, completely surrounds the slip contact and shields it against the outside. The insulation is such that the gun, in the case of a switched-on high voltage, can be submerged without trouble into a water bath for the purpose of cleaning without any flashovers occurring. Naturally, instead of the saponified transformer oil, some other liquid or semisolid insulating material can be filled into the annular chamber 20.

Figure 2:
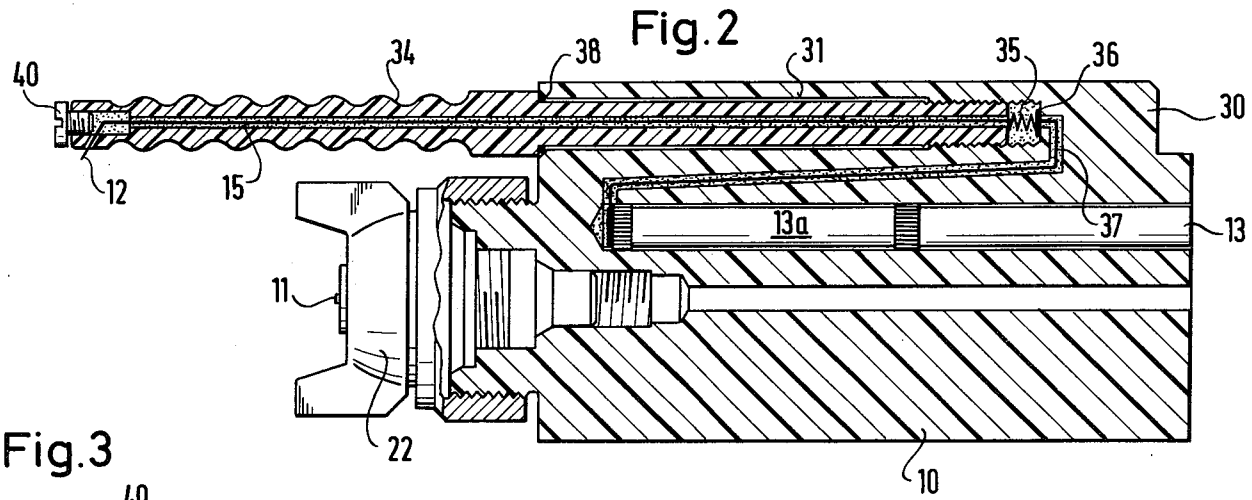
Figure 3:
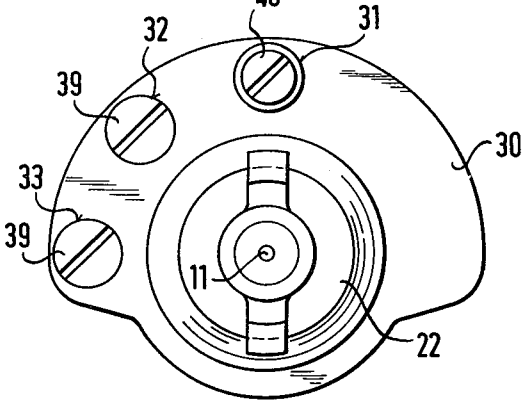

FIGS. 2 and 3 show another embodiment of the invention, whereby for the sake of simplicity only those parts which deviate from the embodiment of FIG. 1 are provided with other reference numbers. As is clear from FIGS. 2 and 3, the pistol barrel 10 has a flange 30 projecting from its jacket. The flange 30 is made of one piece with the pistol barrel 10, (therefore likewise consists of insulating material) and has the shape of a half ring. In the flange 30, there are three blind bores 31, 32 and 33, which run parallel to the longitudinal axis of the pistol barrel. These blind bores serve for releasably plugging-in of an elongated essentially cylindrical extension body 34 of insulating material. This body 34 corresponds in function to the body 14 of insulating material of FIG. 1. It carries the electrode 12 on its front free end. The electric connection between the electrode 12 and the high voltage feed 13 takes place, in the case of this embodiment, by way of the conductor 15 embedded into the body of insulating material 34, a contact spring 35 projecting from the rear end of the body 34, and a small collector plate 36 provided on the bottom of each blind bore. The connector plate 36 leads, by way of a connecting wire 37, to the high voltage feed 13. An annular seal 38, which is fluid-proof, is located on every blind bore 31, 32, 33 and effects a solid and tight seat of the body 34 in the blind bores. Additionally, an insulating medium can be filled into the blind bore.

When using an atomizer head depicted in FIG. 2, the plane of the flat jet is again perpendicular in relation to the plane of the paper. The body of insulating material 34, and thus the electrode 12, lie in the plane of the paper perpendicularly to the jet. According to FIG. 3, the body of insulating material 34 is thus attached in the blind bore 31. Whenever now the atomizer head 22 is twisted by 45°, then in order to maintain the electrode 12 in a plane perpendicularly to the plane of the flat jet, the body of insulating material 34 is removed from the blind bore 31 and is inseted into the blind bore 32. In case of a further turn of the atomizer head 22 by 45°, the body of insulating material 34 is then plugged into the blind bore 33. In order to protect the blind bores, which at any particular time may be empty, covering caps 39 are put on said bores. Naturally, this embodiment too can have numerous variations, especially in regard to the number and development of the blind bores as well as the development of the body of insulating material 34. Thus, for example, in FIG. 2, the body of insulating material 34 is a small tube, which at its free end is covered up by a cap 40, whereby then the electrode 12 is directed out laterally. Furthermore in the case of the example drawn, the body of insulating material 34 is provided at its surface with a corrugated profiling or irregular longitudinal section in order to supress the occurrence of creepages, especially in case of fouling with paint. Finally we still have to point out that the contact spring 35 could also be attached to the floor of the blind bore and not to the body 34.

Figure 4:
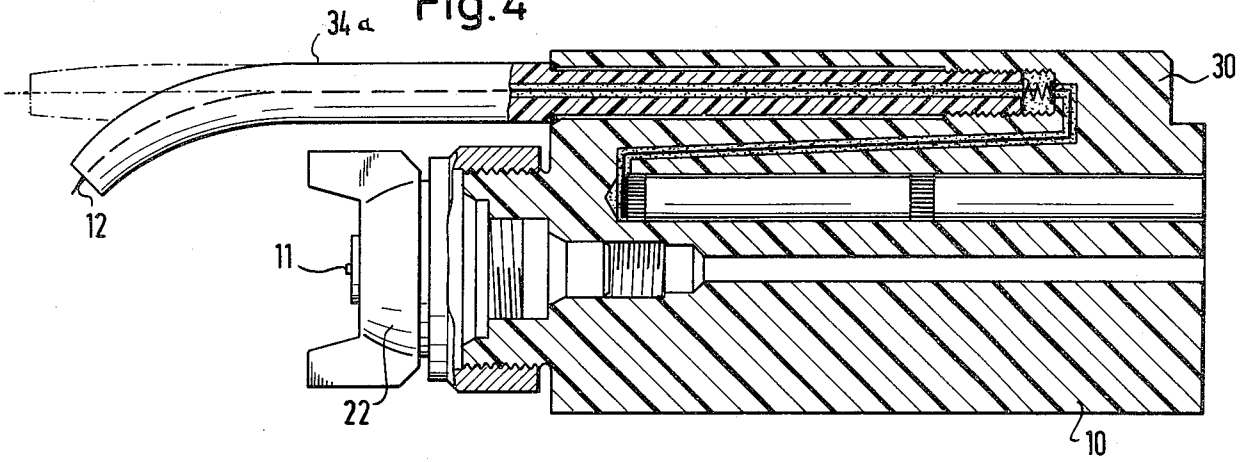

One variation of the arrangement of FIG. 2 is shown in FIG. 4. In that case, the variation merely consists in the fact, that the body 34*a* of insulating material carrying the electrode 12 consists of plastically moldable material in such a way, that the operator will be able to adjust or to readjust the suitable distance between the electrode 12 and the atomizer nozzle by bending of the body 34*a*.

Figure 5:
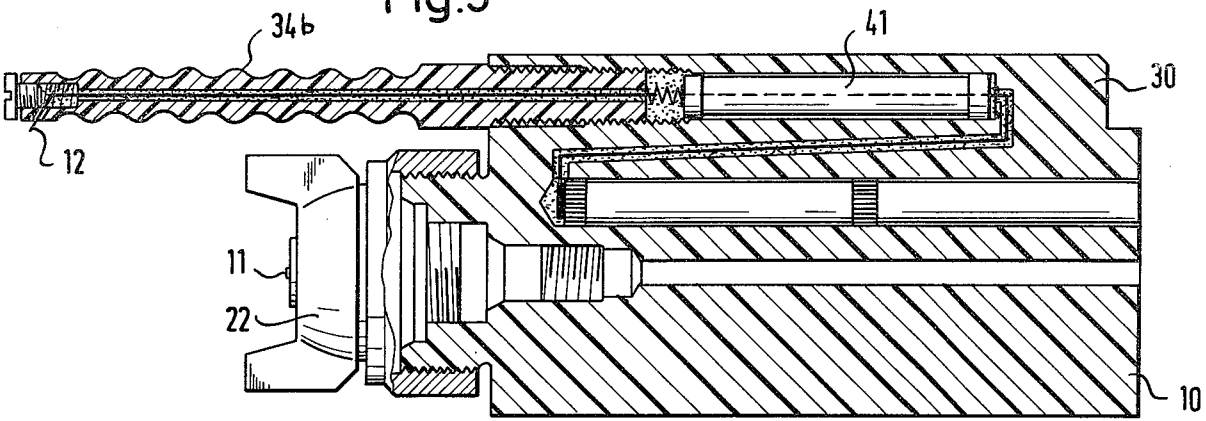

A further variation of the arrangement of FIG. 2 is shown in FIG. 5. In that case, the variation merely consists in the fact that a protective resistor 41 is housed in each of the blind bores 31 to 33, whereby this protective resistor, additionally to the current limiting resistor 13*a*, takes care of a decrease of the electrode capacity. This additional protective resistor 41 however can also be housed in the body of insulating material 34*b*.

Figure 6:
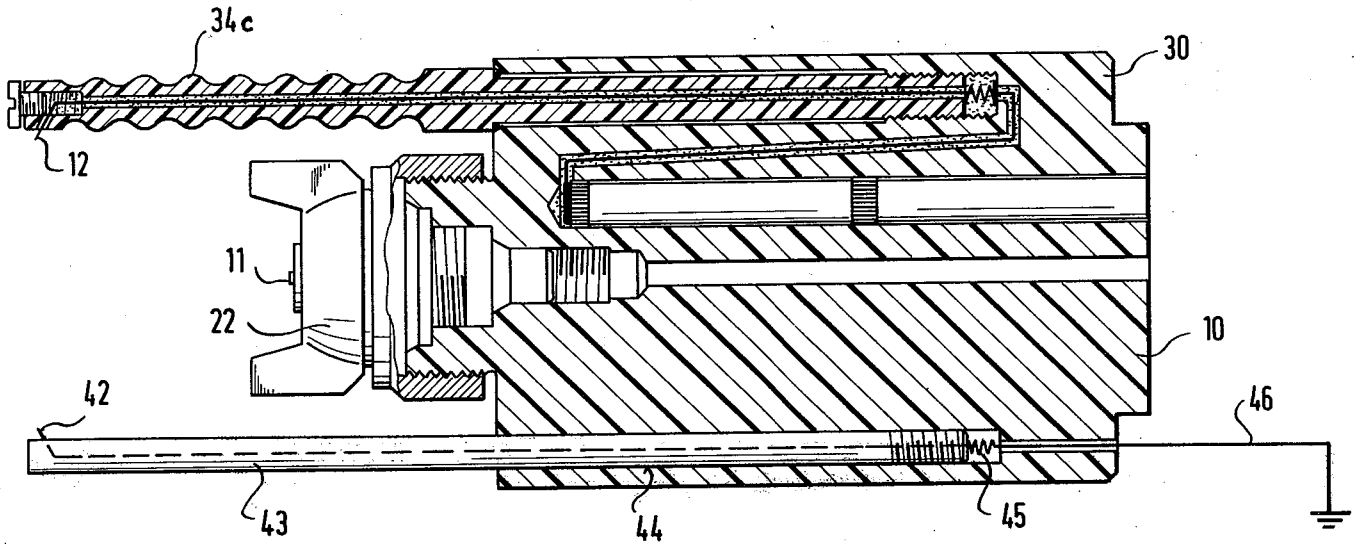

FIG. 6 finally shows an additional variation of the arrangement according to FIG. 2, whereby the variation consists in the fact that, additionally, a grounded counter-electrode 42 has been provided. This counter-electrode 42 is carried by a tube 43 of insulating material, which similarly, as in the case of the body 34*c* of insulating material, is plugged into one of several blind bores 44 of the flange 30, the bores running parallel to the longitudinal axis of the pistol barrel. On the bottom of the blind bores 44, there are contact springs 45 for the purpose of connecting the counter-electrode 42 with a grounding wire 46.

The number of the blind bores 44 for the small tube 43 of insulating material equipped with the counter-electrode 49, generally corresponds to the number of blind bores 31, 32, 33 for the body of insulating material 34*c* carrying the electrode 12. These bores are diametrically opposed to one another. In case of a twisting of the atomizer head 22, not only the body 34*c* of insulating material, but also the insulating tube 43 is replugged in such a way that the electrode 12 and the counter-electrode 42 are again diametrically opposed to each other.

Naturally, the individual characteristics of the various embodiments and variations can be combined with one another. Thus, for example, also in the case of the embodiment according to FIG. 1, a counter-electrode can be provided whereby the counter-electrode is attached to the annular foot 14*b*, diametrically opposed to the electrode 12. Finally, we still want to point out that, as has been explained already in connection with the embodiment of FIG. 1, the invention can be applied advantageously to different kinds of atomizer heads, possibly also in the case of atomizer heads with a grounded metal nozzle.

It will be apparent, in light of the foregoing discussion, that when a highly electrically conductive coating material to be fed from the nozzle 11, the electrode 12 is disposed at a distance therefrom which is selected in accordance with the conductivity of the coating material. The selected distance will be sufficient to effect an intensive charge of the coating material while maintaining the voltage drop at the electrical current-limiting resistor at a minimal value. In other words, the distance between the electrode and the nozzle is selected so that minimal current flow develops between the electrode and nozzle through the highly conductive coating material.

MAJOR ADVANTAGES AND SCOPE OF THE INVENTION

As a result of the present inventive concept of an electrode extension body, coating materials of high conductivity may be effectively electrostatically sprayed with maximum safety. Moreover, by providing an extension body which is adjustable in location, the present invention enables the extension body to be employed with rotatable flat spray nozzles.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In an electrostatic coating gun suitable for coating objects with liquid or powdery coating material of relatively high electrical conductance, the gun having a housing with a coating material feed line disposed therein for connection to a coating material supply source, an atomizer nozzle located at a discharge end of said feed line, an electrode for statically charging atomized coating material particles, and means for connecting an electrical resistor means and high voltage cable to said electrode, the improvement comprising:

an elongated, electrode extension body of insulating material carrying said electrode forwardly of a discharge opening means of said nozzle; and electrical conducting means disposed in said extension body and being electrically connected to an electrical contact on said housing;

said electrical contact on said housing being electrically connectible to the high voltage cable;

said extension body being disposed to locate said electrode forwardly of said nozzle discharge opening means at a distance therefrom which is selected in accordance with the conductivity of said coating material so that the voltage drop at said electrical resistor means is below a predetermined minimal value such that an intensive charging of said highly conductive coating material particles is effected;

said extension body being mounted for rotation about a longitudinal axis extending through said housing in a manner maintaining said distance constant so that said electrode can be rotatably displaced relative to the spray of coating material without changing said distance between said electrode and said nozzle discharge opening means.

2. An electrostatic coating gun for coating objects with water diluted coating material of relatively high electrical conductance, said gun comprising:

a housing;

a coating material feed line disposed in said housing, said feed line being connected to a source of water diluted coating material for conducting said water diluted coating material to a discharge end of said feed line;

an atomizer nozzle located at said discharge end of said feed line, said nozzle having discharge opening means for ejecting a spray of said water diluted coating material toward an object to be coated;

an electrostatic charging assembly for electrostatically charging water diluted coating material being sprayed from said nozzle, said charging assembly comprising:

an elongated electrode extension body fashioned of electrically insulative material and carrying an electrode forwardly of said discharge opening means of said nozzle;

electrical contact means mounted on said housing;

electrical resistor means connected to said contact means and to a source of high voltage to charge said electrode; and electrical conducting means disposed in said extension body and being electrically connected to said electrode and said electrical contact means;

said extension body being disposed to locate said electrode forwardly of said nozzle discharge opening means at a distance therefrom which is in accordance with the conductivity of said water diluted coating material being sprayed so that the voltage drop at said electrical resistor means is below a predetermined minimal value to prevent short-circuiting and effect an intensive charging of said water diluted coating material;

said extension body comprising a plastically moldable material so as to be manually bendable to vary the position of said electrode relative to said discharge opening means.

3. An electrostatic coating gun for coating objects with water diluted coating material of relatively high electrical conductance, said gun comprising:

a housing;

a coating material feed line disposed in said housing, said feed line being connected to a source of water diluted coating material for conducting said water diluted coating material to a discharge end of said feed line;

an atomizer nozzle located at said discharge end of said feed line, said nozzle having discharge opening means for atomizing and ejecting a spray of said water diluted coating material in the form of a flat jet toward an object to be coated;

an electrostatic charging assembly for electrostatically charging water diluted coating material being sprayed from said nozzle, said charging assembly comprising:

an elongated electrode extension body fashioned of electrically insulative material and carrying an electrode forwardly of said discharge opening means of said nozzle;

electrical contact means mounted on said housing;

electrical resistor means connected to said contact means and to a source of high voltage to charge said electrode; and electrical conducting means disposed in said extension body and being electrically connected to said electrode and said electrical contact means;

said extension body being disposed to locate said electrode forwardly of said nozzle discharge opening means at a distance therefrom which is in accordance with the conductivity of said water diluted coating material being sprayed so that the voltage drop at said electrical resistor means is below a predetermined minimal value to prevent short-circuiting and effect an intensive charging of said water diluted coating material;

said extension body lying generally in a plane passing through said nozzle and being perpendicular relative to the plane of the flat jet;

said nozzle being adjustable to accommodate turning of the plane of the flat jet about the longitudinal axis of the housing; and said extension body including an annular portion which is rotatably mounted on said housing without changing the distance between said electrode and said nozzle discharge opening means.

4. An electrostatic coating gun as defined in claim 3 wherein said electrical conducting means includes a spring biased contact element located in said annular portion; said contact on said housing comprising a ring-shaped member disposed around the periphery of said housing; said spring biased contact element being slidably engageable with said ring-shaped contact; said annular portion and said housing defining an annular chamber containing a liquid-like insulating medium surrounding said spring biased contact element and said ring-shaped contact.

5. An electrostatic coating gun as defined in claim 4 wherein said annular chamber is partially defined by a pair of annular grooves located on the periphery of said housing and partially by an annular recess located in a foot portion of said annular portion of said extension body.

6. An electrostatic coating gun as defined in claim 5 wherein said insulating medium comprises saponified transformer oil.

7. An electrostatic coating gun for coating objects with water diluted coating material of relatively high electrical conductance, said gun comprising:

a housing;

a coating material feed line disposed in said housing, said feed line being connected to a source of water diluted coating material for conducting said water diluted coating material to a discharge end of said feed line;

an atomizer nozzle located at said discharge end of said feed line, said nozzle having discharge opening means for ejecting a spray of said water diluted coating material toward an object to be coated;

an electrostatic charging assembly for electrostatically charging water diluted coating material being sprayed from said nozzle, said charging assembly comprising:

an elongated electrode extension body fashioned of electrically insulative material and carrying an electrode forwardly of said discharge opening means of said nozzle;

electrical contact means mounted on said housing;

electrical resistor means connected to said contact means and to a source of high voltage to charge said electrode; and electrical conducting means disposed in said extension body and being electrically connected to said electrode and said electrical contact means;

said extension body being disposed to locate said electrode forwardly of said nozzle discharge opening means at a distance therefrom which is in accordance with the conductivity of said water diluted coating material being sprayed so that the voltage drop at said electrical resistor means is below a predetermined minimal value to prevent short-circuiting and effect and intensive charging of said water diluted coating material;

the portion of said extension body adjacent said electrode being of corrugated longitudinal section to minimize creepage.

8. In an electrostatic coating gun suitable for coating objects with liquid or powdery coating material of relatively high electrical conductance, the gun having a housing with a coating material feed line disposed therein for connection to a coating material supply source, an atomizer nozzle located at a discharge end of said feed line, an electrode for statically charging atomized coating material particles, and means for connecting an electrical resistor means and high voltage cable to said electrode, the improvement comprising:

an elongated, electrode extension body of insulating material carrying an electrode forwardly of a discharge opening means of said nozzle;

said extension body lying in a plane passing through said nozzle;

electrical conducting means disposed in said extension body and being electrically connected to an electrical contact on said housing;

said electrical contact on said housing being electrically connectible to the high voltage cable; and said extension body being disposed to locate said electrode forwardly of said nozzle discharge opening means at a distance therefrom which is selected in accordance with the conductivity of said coating material so that the voltage drop at said electrical resistor means is below a predetermined minimal value such that an intensive charging of said highly conductive coating material particles is effected;

said nozzle means being arranged to atomize the coating material in the form of a flat jet and being adjustable to accommodate turning of said flat jet about the longitudinal axis of said housing;

said housing including a ring-shaped flange having a plurality of bores extending essentially parallel to the longitudinal axis of the housing for selectively receiving said extension body to enable said electrode to be maintained perpendicular to the adjustable plane of the flat jet.

9. An electrostatic coating gun as defined in claim 8 wherein each of said bores is provided with an electrical contact at its bottom and is arranged to make electrical contact with said electrical conducting means in said extension body.

10. An electrostatic coating gun as defined in claim 8 including annular fluid seals disposed at the mouths of said body-receiving bores.

11. An electrostatic coating gun as defined in claim 8 wherein said flange includes a plurality of second bores disposed diametrically opposite said first mentioned bores; said second bores being arranged to selectively receive a grounded counter-electrode.

* * * * *